US010576522B2

(12) United States Patent
Jin et al.

(10) Patent No.: US 10,576,522 B2
(45) Date of Patent: Mar. 3, 2020

(54) MOLD FOR PRESS BRAKE AND HEMMING METHOD

(71) Applicant: AMADA HOLDINGS CO., LTD., Kanagawa (JP)

(72) Inventors: Yingjun Jin, Kanagawa (JP); Takahiro Shibata, Kanagawa (JP); Shiro Hayashi, Kanagawa (JP); Shin Kobayashi, Kanagawa (JP)

(73) Assignee: AMADA HOLDINGS CO., LTD., Kanagawa (JP)

( * ) Notice: Subject to any disclaimer, the term of this patent is extended or adjusted under 35 U.S.C. 154(b) by 562 days.

(21) Appl. No.: 15/124,918

(22) PCT Filed: Mar. 30, 2015

(86) PCT No.: PCT/JP2015/059883
§ 371 (c)(1),
(2) Date: Sep. 9, 2016

(87) PCT Pub. No.: WO2015/152142
PCT Pub. Date: Oct. 8, 2015

(65) Prior Publication Data

US 2017/0021403 A1 Jan. 26, 2017

(30) Foreign Application Priority Data

Apr. 1, 2014 (JP) ..... 2014-075088
Dec. 26, 2014 (JP) ..... 2014-264686

(51) Int. Cl.
*B21D 19/08* (2006.01)
*B21D 5/16* (2006.01)
*B21D 5/02* (2006.01)

(52) U.S. Cl.
CPC ..... *B21D 19/08* (2013.01); *B21D 5/02* (2013.01); *B21D 5/16* (2013.01)

(58) Field of Classification Search
CPC ..... B21D 5/02; B21D 5/0263; B21D 7/06; B21D 7/066; B21D 19/08; B21D 19/082; B21D 5/16; B21D 5/0209
See application file for complete search history.

(56) References Cited

U.S. PATENT DOCUMENTS 6,257,043 B1 7/2001 Wiens
9,868,144 B2 * 1/2018 Artmayr ..... B21D 5/0209
(Continued)

FOREIGN PATENT DOCUMENTS

JP 60-56123 4/1985
JP 60-66622 5/1985
(Continued)

OTHER PUBLICATIONS

EPO Machine Translation of JP 06087028 A (Year: 2019).*
(Continued)

*Primary Examiner* — Pradeep C Battula
(74) *Attorney, Agent, or Firm* — Greenblum & Bernstein, P.L.C.

(57) ABSTRACT

To provide a mold for a press brake in which an ascending and descending member that is relatively pressed and lowered by an upper table in a press brake is provided vertically movably with respect to a mold base mountable on a lower table in the press brake, an upper surface of a workpiece supporting member provided in the mold base and a lower surface of a workpiece pressing member provided in the ascending and descending member vertically face each other, and the upper surface of the workpiece supporting member is inclined so that a front side thereof becomes relatively lower than the lower surface of the workpiece pressing member.

6 Claims, 12 Drawing Sheets

(56) References Cited

U.S. PATENT DOCUMENTS

| | | | | |
|---|---|---|---|---|
| 2010/0257914 | A1* | 10/2010 | Makino | B21D 7/06 72/386 |
| 2013/0283875 | A1 | 10/2013 | Jin et al. | |
| 2014/0283576 | A1 | 9/2014 | Jin et al. | |

FOREIGN PATENT DOCUMENTS

| | | | | | |
|---|---|---|---|---|---|
| JP | 03-230821 | | | 10/1991 | |
| JP | 6-87028 | | | 3/1994 | |
| JP | 06-238353 | | | 8/1994 | |
| JP | 3043386 | | | 11/1997 | |
| JP | 10-137852 | | | 5/1998 | |
| JP | 10137852 | A | * | 5/1998 | |
| JP | 11-197763 | | | 7/1999 | |
| JP | 2003-181546 | | | 7/2003 | |
| JP | 2004-42061 | | | 2/2004 | |
| JP | 2005-349457 | | | 12/2005 | |
| JP | 2005349457 | A | * | 12/2005 | B21D 19/14 |
| JP | 2012-157902 | | | 8/2012 | |
| JP | 2013-116502 | | | 6/2013 | |
| WO | 2010/099559 | | | 9/2010 | |

OTHER PUBLICATIONS

EPO Machine Translation of JP-10137852-A (Year: 2019).*
Search Report issued in International Bureau of WIPO Patent Application No. PCT/JP2015/059883, dated Jun. 23, 2015.
Extended European Search Report issued in Patent Application No. 15773240.5, dated Dec. 13, 2017.
Office Action issued in Japan Counterpart Patent Appl. No. 2014-264686, dated May 8, 2019, along with an English translation thereof.

* cited by examiner (A)

(B)

(C)

(A)

(B)

(A)

(B)

(A)

(B)

(B)

(A)

(B)

| MATERIAL / PLATE THICKNESS | 1.52mm | LIGHTWEIGHT HEMMING DIE | | NEW HEMMING METHOD | |
|---|---|---|---|---|---|
| | | IMAGE | | IMAGE | |
| SPCC / 1.6 mm | FLANGE LENGTH (mm) |  | 10 |  | 10 |
| | PRES-SURIZATION LOAD (ton) | | 52 | | 40 |
| | PLATE THICKNESS AFTER HEMMING (mm) | | 3.58 | | 3.11 3.64 |
| | FLANGE LENGTH (mm) |  | 25 |  | 25 |
| | PRES-SURIZATION LOAD (ton) | | 52 | | 40 |
| | PLATE THICKNESS AFTER HEMMING (mm) | | 3.55 | | 3.15 3.41 |

FIG. 10

| MATERIAL / PLATE THICKNESS | | LIGHTWEIGHT HEMMING DIE | | | NEW HEMMING METHOD | | |
|---|---|---|---|---|---|---|---|
| | 1.15mm | | | IMAGE | | | IMAGE |
| SUS304 / 1.2 mm | FLANGE LENGTH (mm) | 10 | 10 | | 10 | 10 | |
| | PRES-SURIZATION LOAD (ton) | 60 | 60 | | 42 | 42 | |
| | PLATE THICKNESS AFTER HEMMING (mm) | 3.61 | 2.71 | | 3.0 | 3.0 | |
| | FLANGE LENGTH (mm) | 25 | 25 | | 25 | 25 | |
| | PRES-SURIZATION LOAD (ton) | 60 | 60 | | 42 | 42 | |
| | PLATE THICKNESS AFTER HEMMING (mm) | 3.59 | 2.66<br>3.35 | | 3.06 | 3.06 | |

MOLD FOR PRESS BRAKE AND HEMMING METHOD

TECHNICAL FIELD

The present invention relates to a mold for a press brake and a hemming method using the mold, and more particularly relates to a mold for a press brake that can reduce residual stress near a cut edge of a plate-like (sheet-like) workpiece which has been cut for example by laser cutting, and a hemming method using the mold.

BACKGROUND ART

When a plate-like workpiece is to be cut into a rectangular shape for example, laser cutting may be performed. A workpiece that has been cut into a rectangular shape as described above by laser cutting may be subjected to bending along a long bending line in a longitudinal direction of the workpiece. When laser cutting is performed on the plate-like workpiece, residual stress occurs near a cut edge of the workpiece. As exemplified in Japanese Patent Application Laid-open No. 2012-157902 (Patent Literature 1), when the shape of the workpiece cut into a rectangular shape as described above has a strip shape, it has been known that residual stress at the cut edge in the longitudinal direction of the workpiece affects warpage of the workpiece after bending. Further, as exemplified in Japanese Patent Application Laid-open No. 2013-116502 (Patent Literature 2), a mold for reducing residual stress has been proposed.

DISCLOSURE OF INVENTION

Problem to be Solved by the Invention

Patent Literature 1 describes that, when laser cutting is performed on a workpiece SPCC with a thickness of 1.2 millimeters, residual stress at a position close to a cut surface is in a positive (+) direction (tensile stress) and there is a region in which the residual stress changes to a negative direction (a compression direction). In FIG. 7 and the corresponding text in the specification of Patent Literature 1, it is described that residual stress at the cut surface of a workpiece is large and gradually decreases as moving away from the cut surface. Further, it is described that, when the residual stress portion is removed by 0.5 millimeter by wire cut discharge machining, warpage of the workpiece after bending can be effectively suppressed.

Furthermore, in FIG. 10 and the corresponding text in the specification of Patent Literature 1, it is described that as a method of reducing residual stress, laser beams with low output are irradiated to a position close to the cut surface of the workpiece to heat the cut surface, or the cut surface is pressurized by a punch and a die provided in a press or pressurized by a pair of pressing rollers.

In Patent Literature 2, it is described that before performing bending of a workpiece by using a mold for a press brake, an end surface of the workpiece is pressurized by the mold.

Bending of a plate-like workpiece is generally performed by a press brake. Therefore, as described in Patent Literature 1, the configuration in which laser beams are irradiated, the configuration in which a workpiece is punched and pressed by a punch and a die, and the configuration in which a workpiece is pressurized by a pair of pressing rollers require relevant devices other than the press brake, which is not desirable.

The configuration described in Patent Literature 2 is such that a workpiece is pressed in a small pressing width adjusted by a pressing width adjustment mechanism between a flat surface of an end-face pressing upper mold and a flat surface of an end-face pressing lower mold provided in a mold for a press brake, over the entire surface from an end face of the workpiece.

In the configuration of the mold described in Patent Literature 2, when a workpiece is positioned between the end-face pressing lower mold and the end-face pressing upper mold to pressurize the vicinity of the cut surface of the workpiece, if the workpiece is inserted deeply and positioned between the end-face pressing lower mold and the end-face pressing upper mold, a pressure receiving area of the workpiece increases. If the workpiece is inserted shallowly and positioned between the end-face pressing lower mold and the end-face pressing upper mold, a thrust load acts on the end-face pressing upper mold that moves vertically, thereby readily causing a galling (scuffing) phenomenon or the like.

In order to reduce the residual stress by pressurizing the vicinity of the cut surface of the workpiece that has been cut by laser cutting, it is desired to cause plastic deformation by pressurizing the workpiece up to an upper yield point stress or higher, which is the maximum stress in an elastic region. However, in a case of reducing several tens of percent of residual stress, pressurization can be performed under the upper yield point stress or close to the upper yield point stress. That is, in order to reduce the residual stress, it is not always necessary to pressurize the workpiece to the upper yield point stress or higher. However, when a press brake having a small pressurizing force is used, a pressurizing force thereof is insufficient to reduce the residual stress.

Means for Solving Problem

In order to solve the above problems and to achieve the above object, a mold for a press brake according to a first aspect of the present invention comprises: an ascending and descending member that is relatively pressed and lowered by an upper table in a press brake, the ascending and descending member provided vertically movably with respect to a mold base mountable on a lower table in the press brake; a workpiece supporting member provided in the mold base, the workpiece supporting member having an upper surface; and, a workpiece pressing member provided in the ascending and descending member, the workpiece pressing member having a lower surface, wherein the upper surface and the lower surface vertically face each other, and, the upper surface of the workpiece supporting member is inclined so that a front side of the upper surface becomes relatively lower than the lower surface of the workpiece pressing member.

A mold for a press brake according to a second aspect of the present invention comprises an upper mold that is mountable on an upper table and a lower mold mountable on a lower table in a press brake, wherein the upper mold and the lower mold are vertically face each other, and have respective pressurizing surfaces, and, one of the pressurizing surfaces is formed as a level surface and the other is formed as an inclined surface.

BRIEF DESCRIPTION OF THE DRAWINGS

FIG. 10 is an explanatory diagram showing a difference in a pressurization load when the upper surface of the workpiece supporting member is formed to be a flat surface and when the upper surface of the workpiece supporting member is formed to be an inclined surface.

EMBODIMENT FOR CARRYING OUT THE INVENTION

Figure 1:
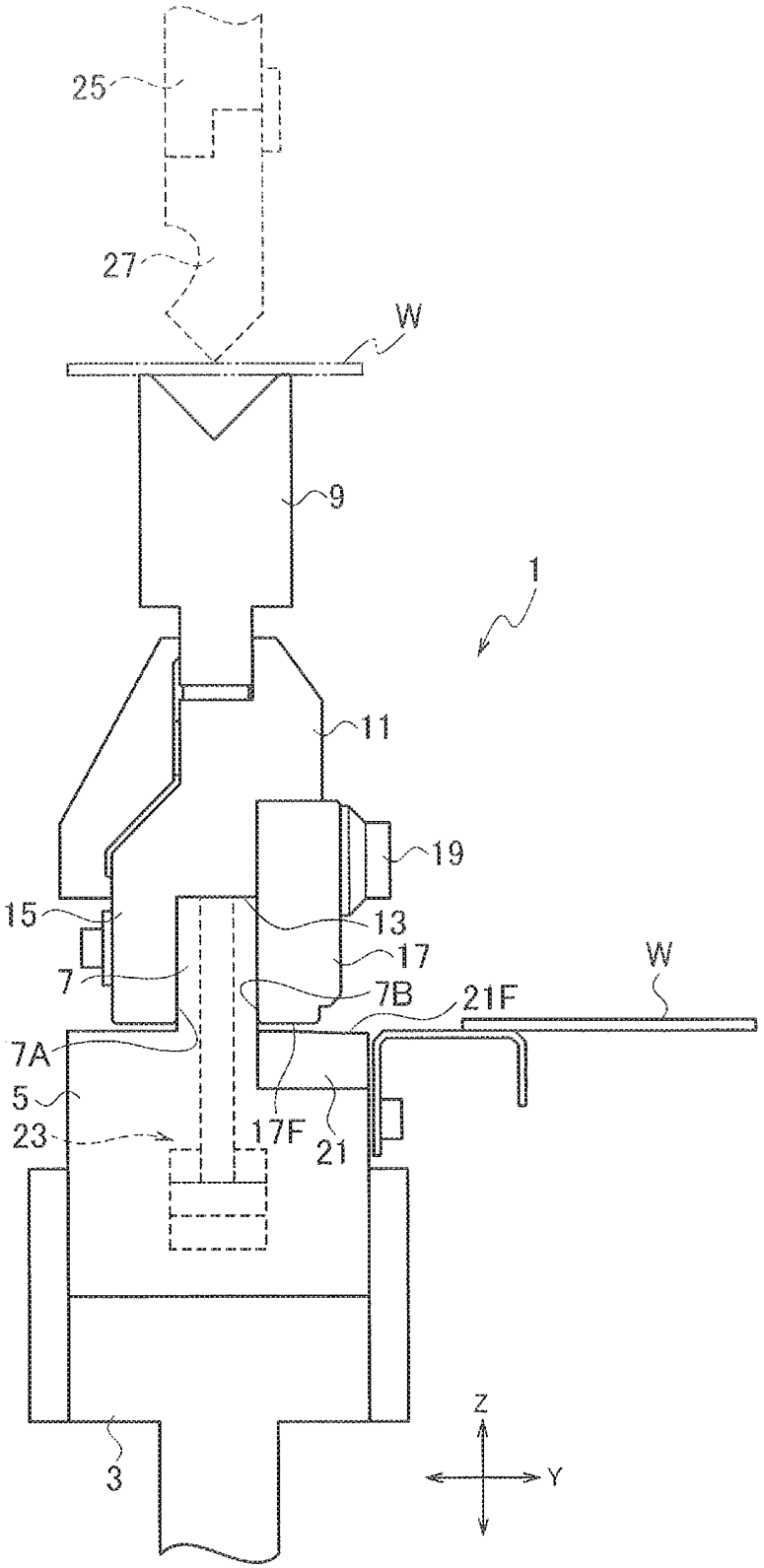
FIG. 1 is an explanatory diagram showing an overall configuration of a mold according to a first embodiment of the present invention.

With reference to FIG. 1, a mold 1 for a press brake according to a first embodiment of the present invention is used by being mounted on a lower table 3 in a press brake (the overall configuration thereof is not shown), and includes a mold base 5 mountable on the lower table 3. The mold base 5 is formed long in a horizontal direction (a direction vertical to the page surface in FIG. 1 and an X-axis direction). An upward protruding portion 7 long in the horizontal direction is provided at the central portion on an upper surface of the mold base 5 and in a front-back direction (a Y-axis direction).

A die holder 11 as an ascending and descending member that can detach and replace a die 9 is vertically movably provided on the upward protruding portion 7. More specifically, the die holder (ascending and descending member) 11 is provided with a lower surface 13 that can abut on an upper surface of the upward protruding portion 7, and a suspending portion 15 that vertically movably comes in surface contact with a vertical rear surface 7A of the upward protruding portion 7 is integrally provided with the die holder 11. Further, a workpiece pressing member 17 that vertically movably comes in surface contact with a vertical front surface 7B of the upward protruding portion 7 and is long in the horizontal direction is provided on the die holder 11 detachably and replaceably via an attachment tool 19 such as a screw.

A workpiece supporting member 21 that vertically faces the workpiece pressing member 17 and is long in the horizontal direction is provided on the mold base 5 detachably and replaceably. In order to provide the die holder 11 vertically movably with respect to the mold base 5, an actuator 23 for vertical movement such as a fluid pressure cylinder is installed in the mold base 5. As the configuration in which the die holder 11 is provided vertically movably with respect to the mold base 5, such a configuration is also possible that a biasing (an energizing) unit such as a coil spring is provided instead of the actuator 23 for vertical movement to press and bias (energize) the die holder 11 in an upward direction at all times.

The die holder 11 is detachably and replaceably provided with the die 9 that works with a punch 27 detachably and replaceably provided on an upper table 25 in the press brake to perform bending of a plate-like workpiece W.

In the configuration described above, after the workpiece W is positioned on the die 9, while holding the lower surface 13 of the die holder 11 in a state of abutting on the upper surface of the upward protruding portion 7 in the mold base 5, by relatively lowering and engaging the punch 27 with the die 9, bending of the workpiece W in a V shape can be performed. As described above, when the workpiece W is formed in a rectangular shape by laser cutting, residual stress at opposite end edges of the workpiece W in the longitudinal direction may affect warpage of the workpiece W after the bending.

Therefore, the mold 1 according to the present embodiment has a function of pressurizing an end edge of the plate-like workpiece W to reduce residual stress at the end edge. More specifically, the configuration is such that the end edge of the workpiece W is pressurized between the lower surface of the workpiece pressing member 17 and the upper surface of the workpiece supporting member 21. That is, when the lower surface 13 of the die holder 11 abuts on the upper surface of the upward protruding portion 7 in the mold base 5, the lower surface of the workpiece pressing member 17 and the upper surface of the workpiece supporting member 21 come into contact with each other, or are slightly away from each other.

An upper surface 21F of the workpiece supporting member 21 is formed as an inclined surface with the front side (the right side in FIG. 1) being low, and a lower surface 17F of the workpiece pressing member 17, which is a pressurizing surface, is formed as a level surface. That is, the upper surface 21F of the workpiece supporting member 21 is inclined so that the front side (the right side in FIG. 1) when guiding the workpiece W between the workpiece pressing member 17 and the workpiece supporting member 21 becomes lower. Accordingly, the workpiece W can be easily inserted between the workpiece pressing member 17 and the workpiece supporting member 21 from the front side.

As described above, when the workpiece W is inserted between the workpiece pressing member 17 and the workpiece supporting member 21, the end edge of the workpiece W abuts on the front surface 7B of the upward protruding portion 7 and is positioned. Accordingly, the front surface 7B of the upward protruding portion 7 constitutes a guide surface along which the workpiece pressing member 17 slides vertically, and constitutes a workpiece positioning surface with which the workpiece W is brought into contact to perform positioning.

As described above, when the workpiece W is inserted between the workpiece pressing member 17 and the workpiece supporting member 21 and abuts on the front surface 7B of the upward protruding portion 7, the end edge of the workpiece W corresponds to a topmost portion of the inclined upper surface 21F of the workpiece supporting member 21. Accordingly, when the upper table 25 in the press brake is relatively lowered to press the die 9, the workpiece pressing member 17 is lowered, and the lower surface 17F comes into contact with the workpiece W to press the workpiece W. In this stage, the contact between the end edge of the workpiece W and the upper surface 21F of the workpiece supporting member 21 becomes line contact.

Accordingly, when the workpiece pressing member 17 is relatively pressed and lowered by the upper table 25, stress concentration occurs at the end edge of the workpiece W, the end edge of the workpiece W has upper yield point stress, and residual stress at the end edge of the workpiece W is reduced. When the end edge of the workpiece W plastically deforms and the contact between the upper surface 21F of the workpiece supporting member 21 and the end edge of the workpiece W becomes a slight surface contact, residual stress at this portion is also reduced. Because there is a limit in the pressurizing force of the press brake, when the range of the plastic deformation near the end edge of the workpiece W gradually increases, and surface contact between the upper surface 21F of the workpiece supporting member 21 and the vicinity of the end edge of the workpiece W gradually increases, it becomes difficult to pressurize the vicinity of the end edge of the workpiece W up to the upper yield point stress.

As is understood from the above descriptions, because the contact between the end edge of the workpiece W and the inclined upper surface 21F of the workpiece supporting member 21 changes from the initial line contact to the surface contact by pressurization, the vicinity of the end edge of the workpiece W can be pressurized up to the upper yield point stress in the range where the surface contact is small, and the residual stress can be reduced. It is relative as to whether to form the upper surface 21F of the workpiece supporting member 21 as an inclined surface or to form the lower surface 17F of the workpiece pressing member 17 as an inclined surface. Therefore, it suffices to form at least one of the lower surface 17F of the workpiece pressing member 17 and the upper surface 21F of the workpiece supporting member 21 as an inclined surface.

Figure 2:
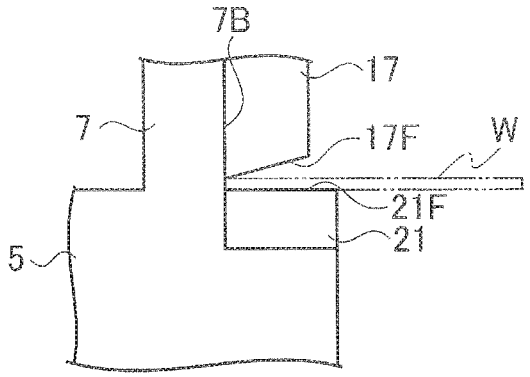
FIG. 2 are explanatory diagrams showing a mode of a pressurizing surface for pressing an end edge portion of a workpiece.
Figure 2:
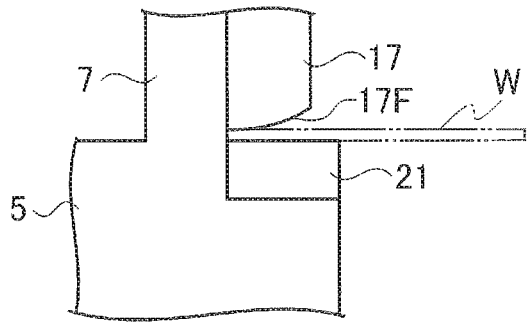
Figure 2:
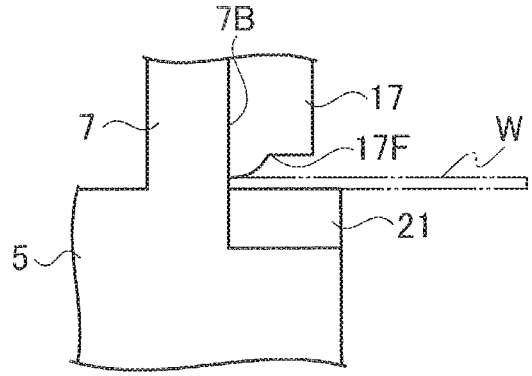

Meanwhile, a case where the upper surface 21F of the workpiece supporting member 21 is formed as an inclined surface has been described. However, as shown in FIG. 2(A), the lower surface 17F of the workpiece pressing member 17 can be formed as an inclined surface with the front side thereof becoming gradually higher, or as shown in FIG. 2(B), the lower surface 17F can be formed as a curved surface with the front side thereof becoming gradually higher. Further, as shown in FIG. 2(C), a curved surface or an inclined surface can be formed at a rear-side part of the lower surface 17F of the workpiece pressing member 17, and a front-side part thereof can be a level surface. In the respective configurations, hemming can be performed between the lower surface 17F of the workpiece pressing member 17 and the upper surface 21F of the workpiece supporting member 21.

Figure 3:
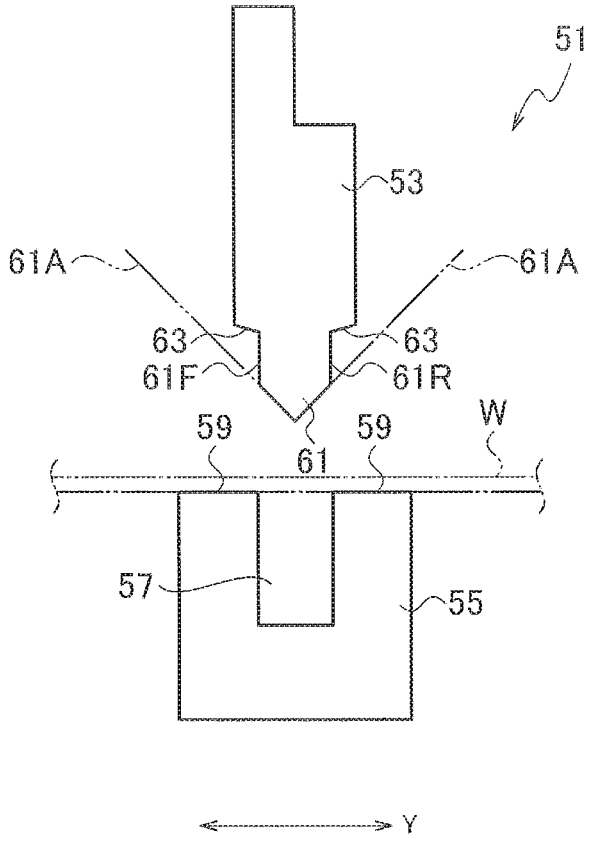
FIG. 3 is an explanatory diagram showing an overall configuration of a mold according to a second embodiment of the present invention.
Figure 4:
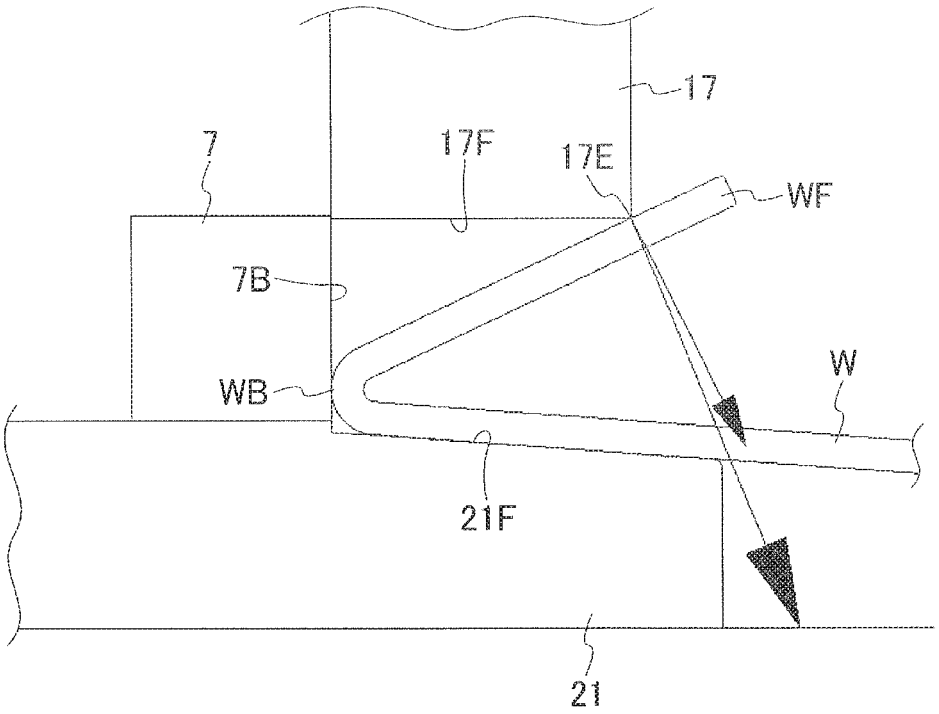
FIG. 4 are explanatory diagrams of computer simulation when a workpiece is subjected to hemming.
Figure 4:
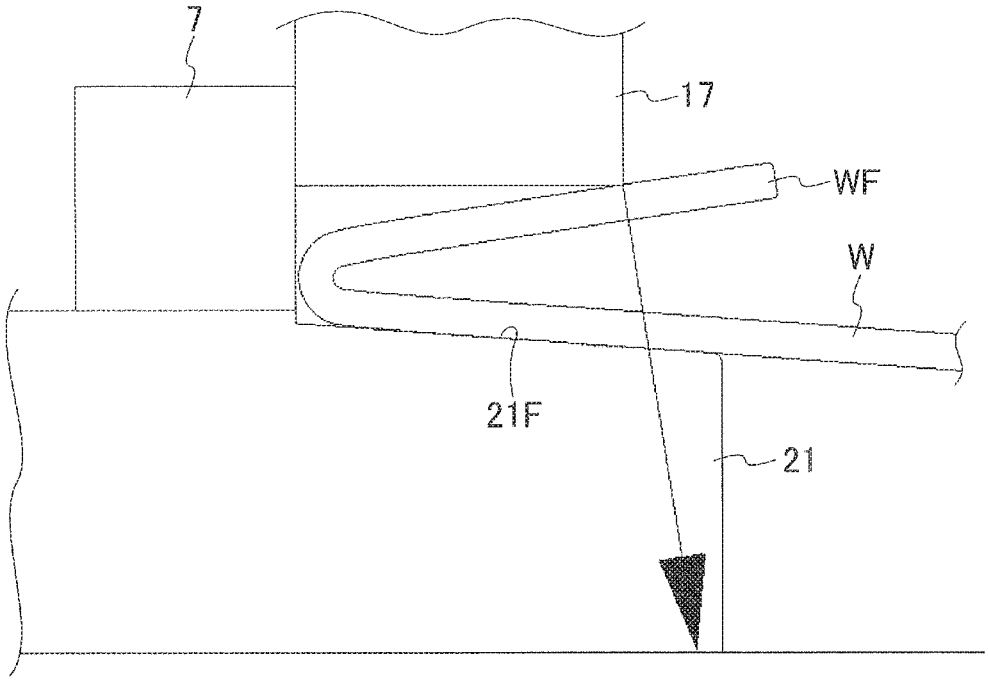
Figure 5:
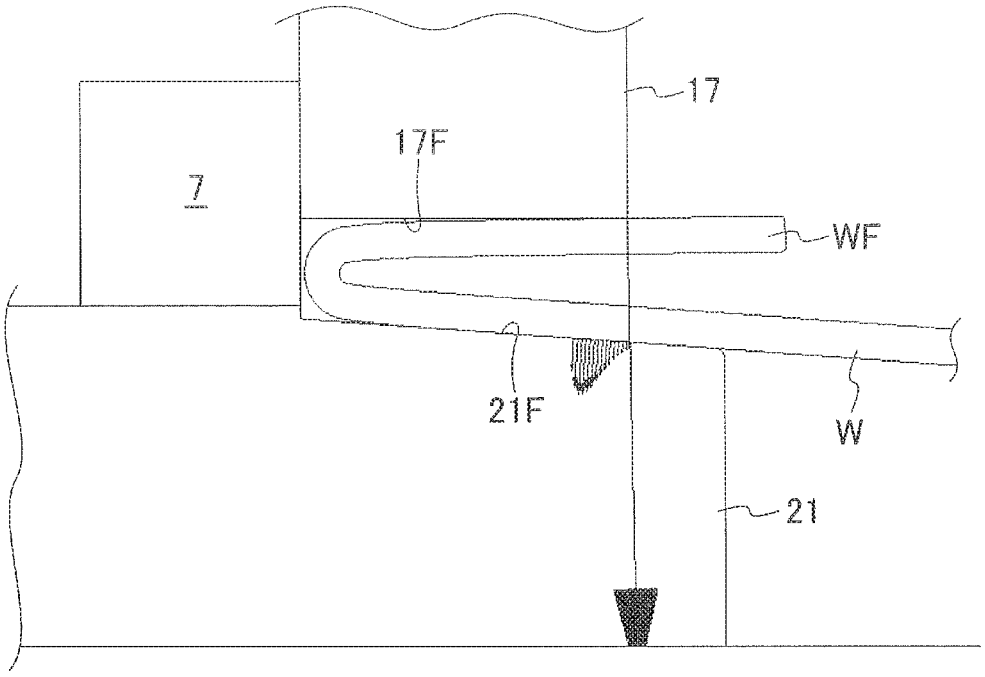
FIG. 5 are explanatory diagrams of computer simulation when a workpiece is subjected to hemming.
Figure 5:
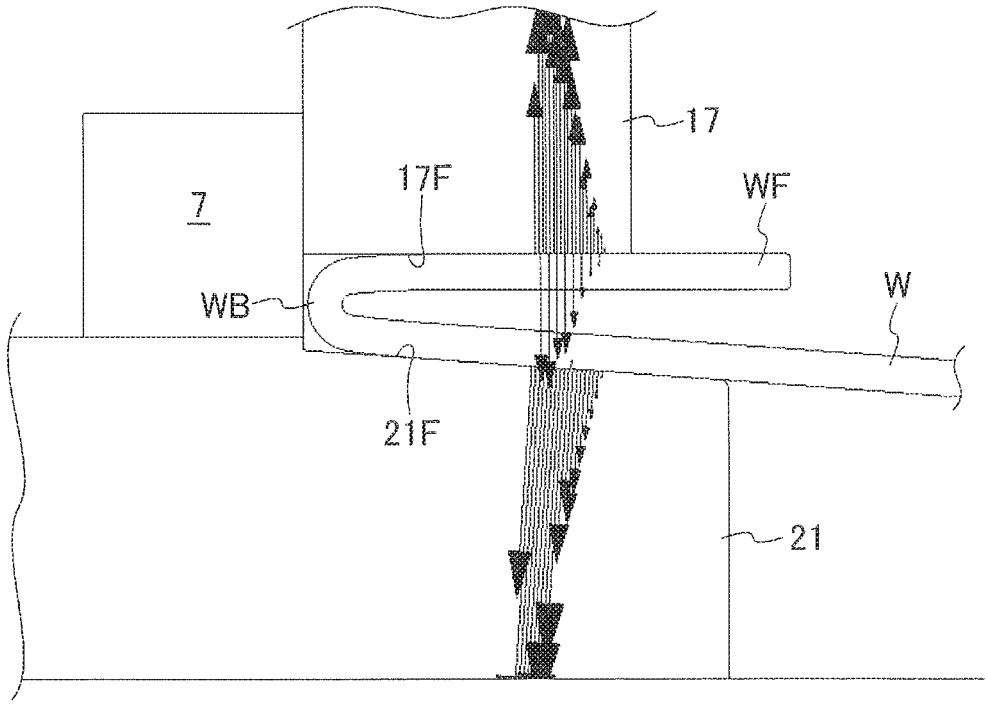
Figure 6:
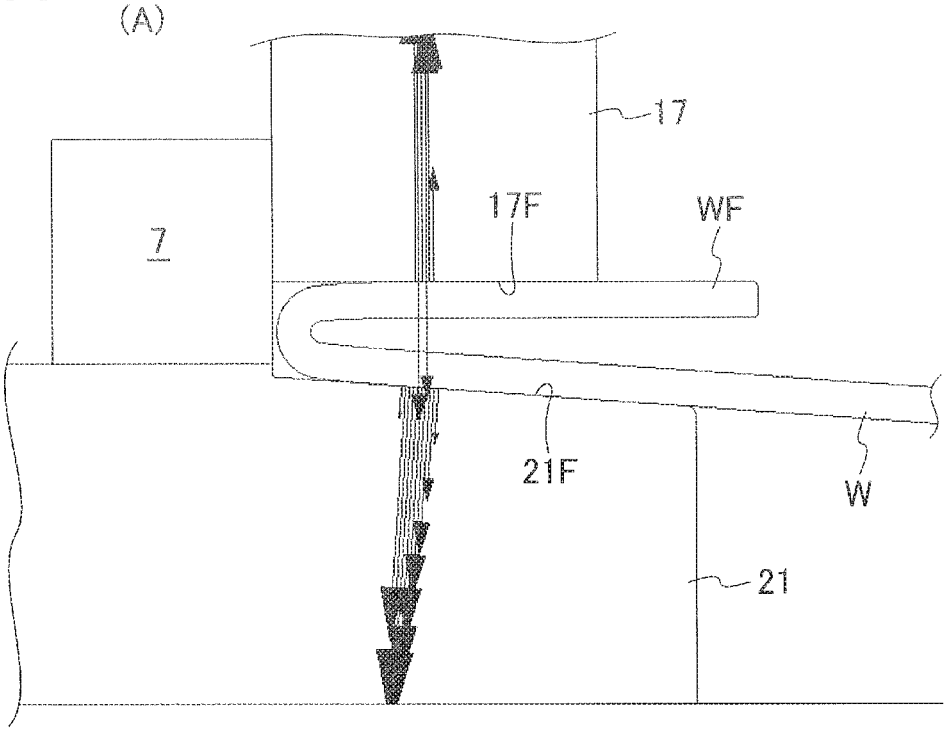
FIG. 6 are explanatory diagrams of computer simulation when a workpiece is subjected to hemming.
Figure 6:
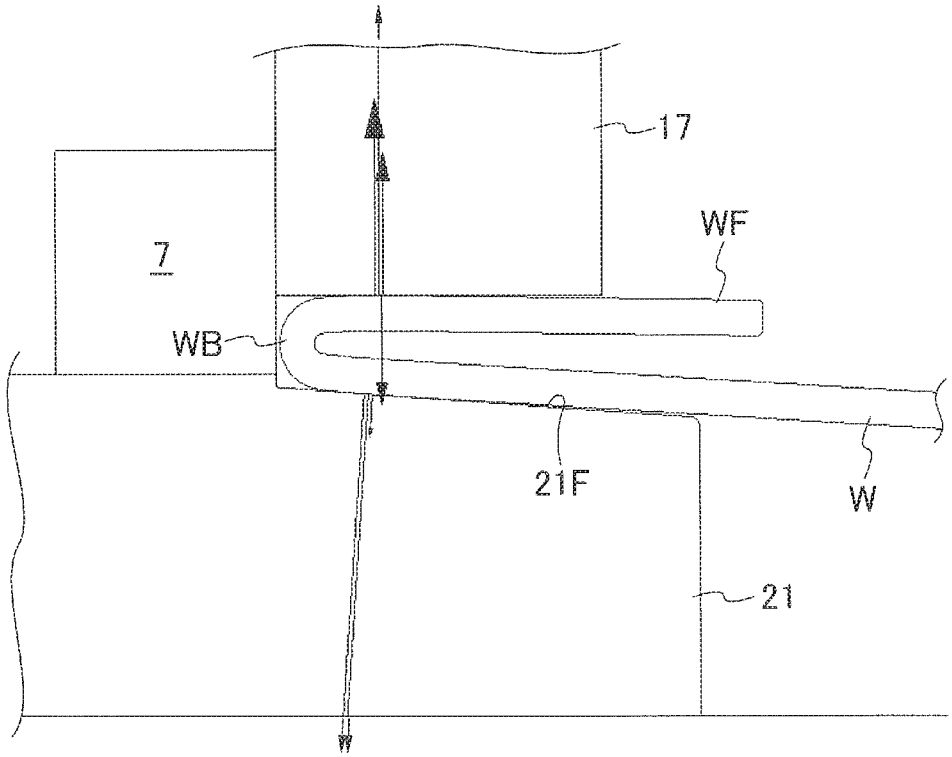
Figure 7:
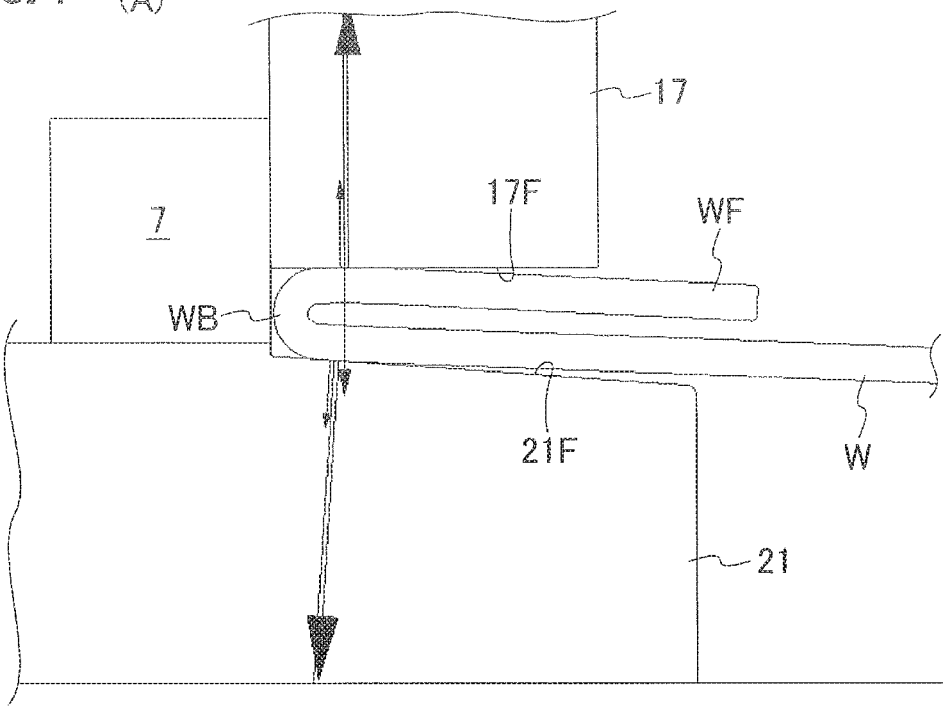
FIG. 7 are explanatory diagrams of computer simulation when a workpiece is subjected to hemming.
Figure 7:
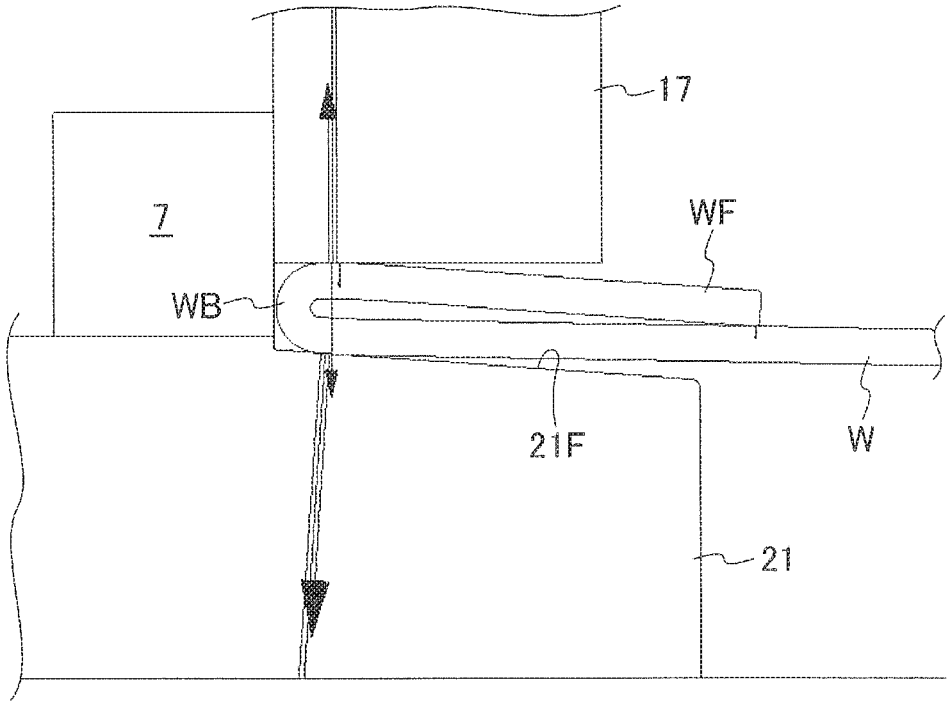
Figure 8:
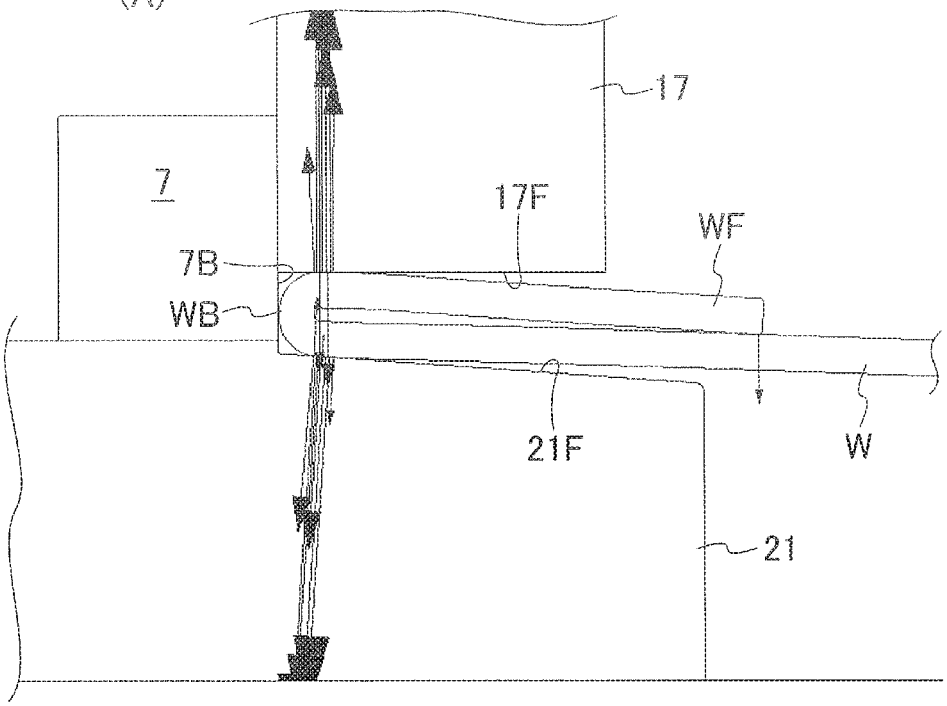
FIG. 8 are explanatory diagrams of computer simulation when a workpiece is subjected to hemming.
Figure 8:
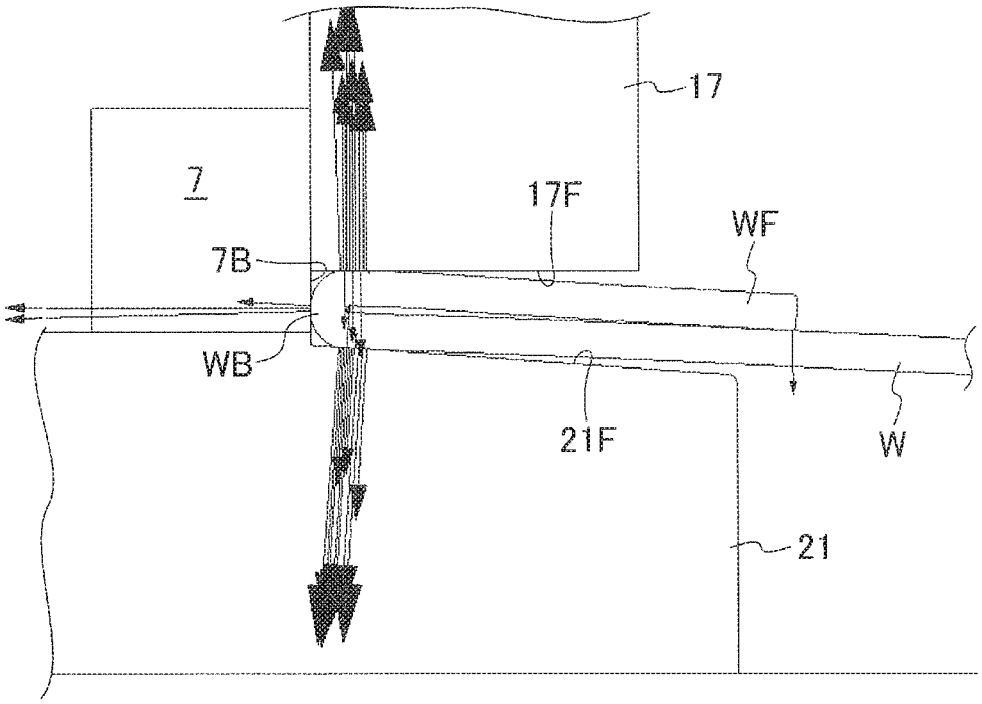

FIG. 3 is an explanatory diagram of a mold according to a second embodiment. A mold 51 according to the second embodiment includes an upper mold (a punch) 53 mountable on an upper table (not shown) in a press brake, and a lower mold (a die) 55 mountable on a lower table (not shown). The lower mold 55 includes a bending groove 57 with which the upper mold 53 can be engaged at the time of bending a workpiece W in a V shape. An upper surface 59 of the lower mold 55 is formed as a level surface.

The upper mold 53 includes a workpiece pressing portion 61 formed in a V shape at a lower part thereof to press the workpiece W into the bending groove 57. A pressurizing surface 63 that can pressurize the workpiece W by putting the workpiece W between the upper surface 59 of the lower mold 55 and the pressurizing surface 63 is provided at an upper position of the workpiece pressing portion 61. The pressurizing surface 63 is formed by forming a step portion on the both front and rear sides of a base end portion of the workpiece pressing portion 61 in the upper mold 53.

The pressurizing surface 63 is formed at the step portion positioned inside of extending portions 61A on the V-shaped inclined surfaces of the workpiece pressing portion 61. Accordingly, when bending of the workpiece W in a V shape is performed by the workpiece pressing portion 61, the pressurizing surface 63 does not interfere with the workpiece W. The pressurizing surfaces 63 are slightly inclined so that the both front and rear sides become higher than a middle portion, respectively. The pressurizing surface 63 can be formed as a curved surface or the like as in the configuration of the lower surface 17F shown in FIGS. 2(B) and 2(C).

In the above configuration, the workpiece pressing portion 61 of the upper mold 53 is engaged with the bending groove 57 in the lower mold 55 and is held in a state where the upper surface 59 of the lower mold 55 and the pressurizing surface 63 of the upper mold 53 are slightly away from each other. The end edge of the workpiece W is then inserted between the upper surface 59 and the pressurizing surface 63 and is brought into contact with a vertical front surface 61F or a vertical rear surface 61R in the workpiece pressing portion 61, to perform positioning of the end edge of the workpiece W. Accordingly, the front surface 61F and the rear surface 61R of the workpiece pressing portion 61 in the upper mold 53 constitute a workpiece positioning surface with which the end edge of the workpiece W is brought into contact to perform positioning.

As described above, after the end edge of the workpiece W is inserted between the upper surface 59 of the lower mold 55 and the pressurizing surface 63 of the upper mold 53 and is positioned so that the end edge of the workpiece W abuts on the front surface 61F of the upper mold 53, when the upper mold 53 is relatively lowered to pressurize the workpiece W, stress concentration occurs at the end edge of the workpiece W because the pressurizing surface 63 is inclined. Therefore, distortion (plastic deformation) equal to or larger than distortion at the upper yield point occurs at the end edge of the workpiece W. The contact surface between the end edge portion of the workpiece W and the pressurizing surface 63 gradually increases. Accordingly, the residual stress near the end edge portion of the workpiece W can be reduced.

After reduction of the residual stress at the end edge portion of the workpiece W, as described above, the workpiece W is placed and positioned on the upper surface 59 of the lower mold 55, and the workpiece W is pressed into the bending groove 57 in the lower mold 55 by the workpiece pressing portion 61 of the upper mold 53, thereby enabling to perform bending on the workpiece W in the V shape.

As is understood from the above descriptions, residual stress at a rear edge of the workpiece W can be reduced by the molds 1 and 51 mounted on the press brake, and bending of the workpiece W in a V shape can be performed by the molds 1 and 51.

As described above, in the mold 1, hemming of the workpiece can be performed between the lower surface 17F of the workpiece pressing member 17 and the upper surface of the workpiece supporting member 21. Results as shown in FIGS. 4 to 8 are obtained by computer simulation of hemming by the mold 1.

That is, the workpiece W bent in an acute angle beforehand is placed on the upper surface 21F of the workpiece supporting member 21, and a bent portion WB of the workpiece W is positioned so as to abut on the front surface 7B of the upward protruding portion 7. When the workpiece pressing member 17 is lowered to press a flange portion WF of the workpiece W, a front end edge 17E of the lower surface 17F in the workpiece pressing member 17 presses the flange portion WF (see FIG. 4(A)). At this time, slight elastic deformation occurs at a part where the flange portion WF is pressed by the front end edge 17E, and a pressing direction of the workpiece pressing member 17 is a direction vertical to an inclined surface of the flange portion WF.

Thereafter, the flange portion WF is further pressed and bent to gradually decrease a bending angle of the workpiece W, and the pressing direction with respect to the flange portion WF by the front end edge 17E of the workpiece pressing member 17 is gradually changed to the vertical direction (see FIG. 4(B)). When the workpiece is further bent by the workpiece pressing member 17, the lower surface 17F of the workpiece pressing member 17 gradually comes into surface contact with (against) the flange portion WF of the workpiece W, and the contact position gradually shifts in a direction toward the bent portion WB (see FIGS. 5(A) and 5(B)).

At this time, the pressing force of the workpiece pressing member 17 to press the flange portion WF increases more on the side of the bent portion WB than on the end side of the flange portion WF (see FIG. 5(B)). As described above, the workpiece W strongly presses the upper surface 21F of the workpiece supporting member 21 corresponding to the position where the workpiece pressing member 17 presses the flange portion WF downward (see FIG. 5(B)). That is, the vicinity of the position where the workpiece pressing member 17 presses the flange portion WF and the vicinity of the position where the workpiece W presses the upper surface 21F of the workpiece supporting member 21 face each other vertically.

Subsequently, when the flange portion WF is further bent by the workpiece pressing member 17, the end side of the flange portion WF is gradually lowered. The contact area between the lower surface 17F of the workpiece pressing member 17 and the flange portion WF gradually decreases, and the position where the workpiece pressing member 17 presses the flange portion WF shifts toward the bent portion WB even further. The position where the workpiece W strongly presses the upper surface 21F of the workpiece supporting member 21 also further shifts toward the bent portion WB corresponding to the pressing position on the side of the flange portion WF (see FIGS. 6(A) and 6(B)).

When the flange portion WF is further bent by the workpiece pressing member 17, as is understood from FIGS. 6(A) and 6(B), the position where the workpiece pressing member 17 presses the flange portion WF is a position closer to the end side of the flange portion WF than a bending central position of the bent portion WB. Therefore, downward moment acts on the end side of the flange portion WF, and the end side of the flange portion WF becomes a detached and free state from the lower surface 17F of the workpiece pressing member 17 (see FIG. 7(A)). The position where the workpiece W presses the upper surface 21F of the workpiece supporting member 21 is a position substantially vertically facing (corresponding) the position where the workpiece pressing member 17 presses the flange portion WF and is a position on the opposite side of the bent portion WB, with the bending central position of the bent portion WB therebetween.

Accordingly, a reaction force when the workpiece W presses the upper surface 21F acts on the workpiece W. The workpiece W becomes the free state detached from the end edge of the upper surface 21F of the workpiece supporting member 21 due to the moment caused by the reaction force (see FIG. 7(A)). That is, a free end side of the workpiece W (the right end side in FIGS. 7(A) and 7(B)) is held in the state detached from the lower surface (the pressurizing surface) 17F of the workpiece pressing member 17 and the upper surface 21F of the workpiece supporting member 21. When the bending by pressing by the workpiece pressing member 17 proceeds further, the end side of the flange portion WF abuts on the upper surface of the workpiece W (see FIG. 7(B)).

As described above, in the state where the end side of the flange portion WF of the workpiece W abuts on the upper surface of the workpiece W, hemming is performed by strongly pressing and squashing the bent portion WB of the workpiece W. At this time, the lower surface 17F of the workpiece pressing member 17 does not come into contact with the flange portion WF over the entire surface, and presses the vicinity of the bent portion WB from above. The upper surface 21F of the workpiece supporting member 21 also supports the vicinity of the bent portion of the workpiece W from below (see FIGS. 7(B), 8(A), and 8(B)).

That is, an area where the lower surface 17F of the workpiece pressing member 17 pressurizes the workpiece W and an area where the upper surface 21F of the workpiece supporting member 21 pressurizes the workpiece W are areas of pressing upper and lower curved surfaces in the bent portion WB of the workpiece W which are small. Accordingly, even if stress concentration occurs and a pressing force (a pressurizing force) of the workpiece pressing member 17 is relatively small, hemming can be performed.

As described above, when hemming of the workpiece W is to be performed, because the end side of the flange portion WF of the workpiece W is pressed to the upper surface of the workpiece W, the bent portion WB of the workpiece W undergoes deformation in the left direction in FIGS. 8(A) and (8B), and is strongly pressed to the front surface 7B of the upward protruding portion 7 (see FIG. 8(B)). Accordingly, the curved surface of the bent portion WB undergoes deformation by being pressed to the front surface 7B. That is, a planar portion is formed by being pressed to the front surface 7B in a part of the smooth curved surface in the bent portion WB.

Figure 9:
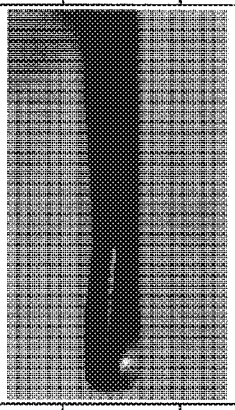
FIG. 9 is an explanatory diagram showing a difference in a pressurization load when an upper surface of a workpiece supporting member is formed to be a flat surface and when the upper surface of a workpiece supporting member is formed to be an inclined surface.
Figure 9:
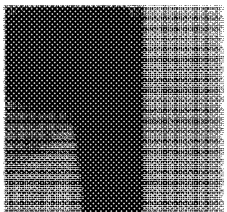
Figure 9:
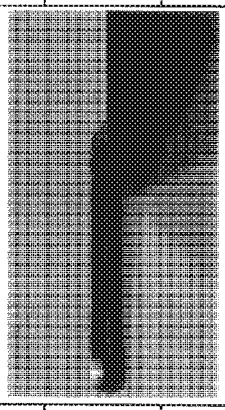
Figure 9:
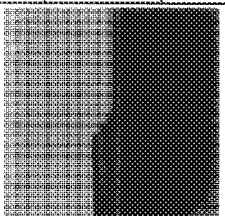
Figure 11:
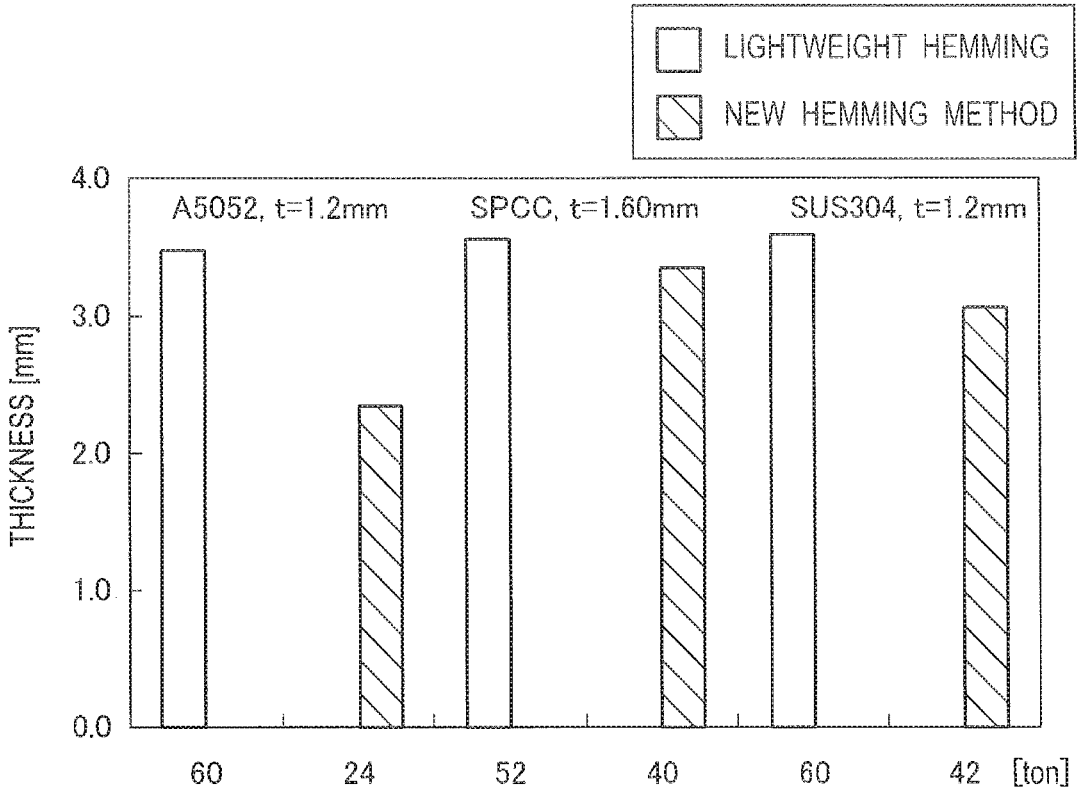
FIG. 11 is an explanatory diagram showing a reducing effect of a pressurization load when the upper surface of the workpiece supporting member is formed to be an inclined surface.

Therefore, verification as to whether a pressing force (a pressurizing force) actually decreases when hemming is performed by the mold 1 having the configuration in which the upper surface 21F of the workpiece supporting member 21 is inclined to be low on the front side, was performed. That is, in molds 1 having the same configuration, hemming is performed by using a mold in which the lower surface 17B of the workpiece pressing member 17 is formed as a level surface and the upper surface 21F of the workpiece supporting member 21 is level (a lightweight hemming die) and by using a mold in which the upper surface 21F is inclined to be low on the front side (a new hemming method). The results are as shown in FIGS. 9 to 11. In FIGS. 9 and 10, two types of plate thickness after hemming written vertically indicate a thickness of the bent portion WB in the flange portion WF of the workpiece W and a thickness in a state where the end side of the flange portion WF is detached.

As is clear from FIGS. 9 to 11, when the pressurization loads are the same (60 tons and 52 tons), the plate thickness can be made thinner by a mold in which the upper surface 21F of the workpiece supporting member 21 is formed low on the front side (the new hemming method). In the mold in which the upper surface 21F of the workpiece supporting member 21 is formed low on the front side, the plate thickness after hemming can be made thinner even if the pressurization load is small (for example, in the case of 40 tons and 42 tons) (see FIGS. 9 to 11). Hemming of workpieces made of various materials has been performed, with the inclination angle of the upper surface 21F being held constant. It is desired to use a detachable and replaceable workpiece supporting member 21 having different inclination angles of the upper surface 21F corresponding to the material and the plate thickness of a workpiece.

Figure 12:
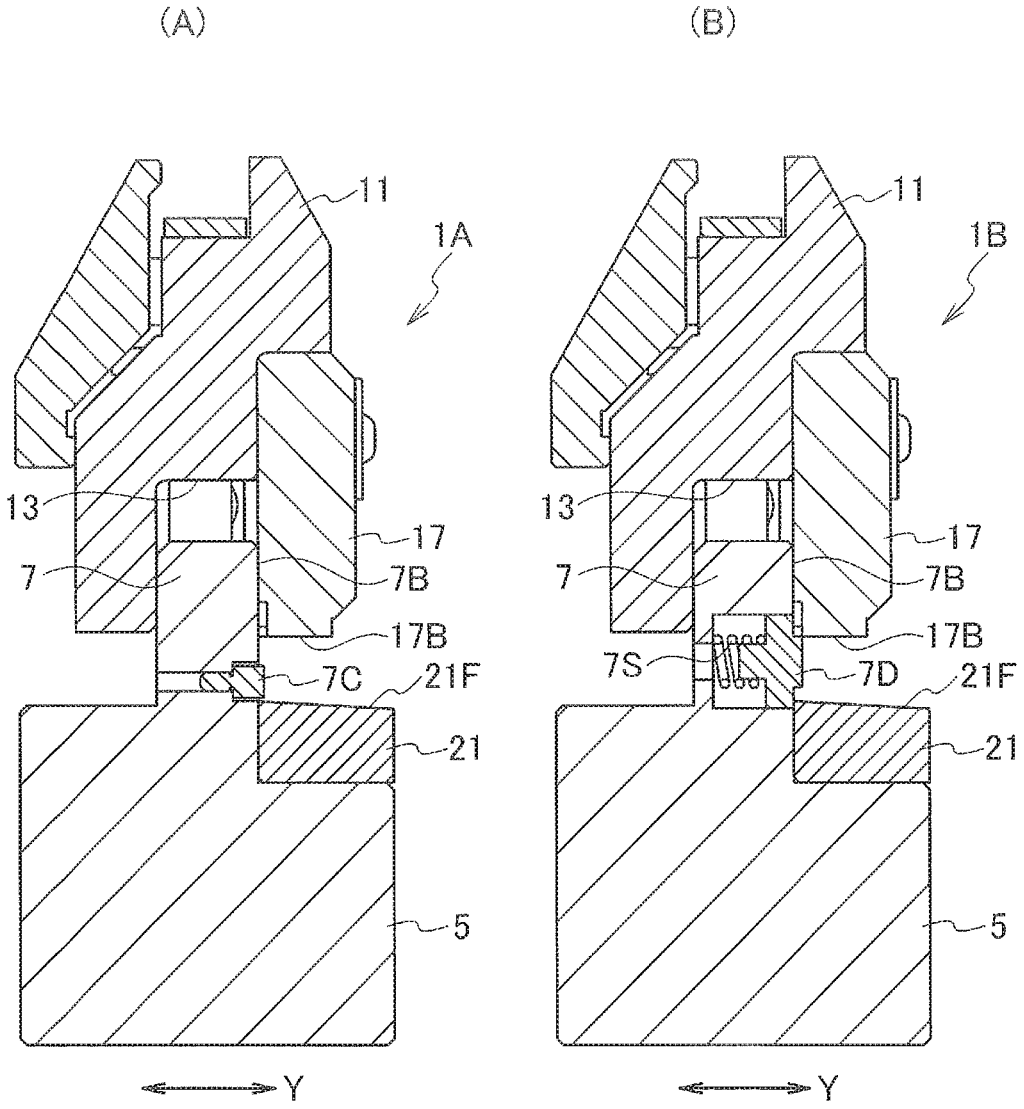
FIG. 12 are explanatory diagrams showing a deformation mode of a mold.

In order to prevent that the bent portion WB of the workpiece W is pressed to the front surface 7B and is slightly deformed, molds 1A and 1B as shown in FIGS. 12(A) and 12(B) were prepared. The overall configuration of the molds 1A and 1B is substantially the same as the configuration of the mold 1 described above. Therefore, constituent elements having like functions are denoted by like reference characters, and redundant descriptions thereof will be omitted.

The mold 1A shown in FIG. 12(A) has a configuration in which an elastic member 7C such as rubber that can abut on a workpiece W is provided in the front surface 7B of the upward protruding portion 7 so as to slightly protrude frontward (rightward in FIG. 12(A)). The mold 1B shown in FIG. 12(B) has a configuration in which a striking member 7D is biased (energized) frontward by an elastic member 7S such as a coil spring installed in the upward protruding portion 7 so as to protrude slightly. The elastic member 7C and the striking member 7D are respectively provided in plural in the horizontal direction with an appropriate interval.

According to the molds 1A and 1B having the configuration described above, when hemming of the workpiece W is to be performed, as shown in FIG. 8(B), when the bent portion WB of the workpiece W is pressed to the front surface 7B of the upward protruding portion 7 as described above, the elastic member 7C and the striking member 7D are pressed and deformed (pressed and moved) to allow leftward deformation of the workpiece W in FIG. 8(B). Therefore, slight deformation of the bent portion WB of the workpiece W caused by pressing thereof to the front surface 7B can be prevented.

According to the present invention, when a workpiece is arranged between a workpiece supporting member and a workpiece pressing member and pressurized, an initial contact state between an end edge of the workpiece and the workpiece pressing member is line contact, because an upper surface of the workpiece supporting member is inclined relatively to a lower surface of the workpiece pressing member. Therefore, even if an initial pressurizing force is small, stress concentration occurs at the end edge of the workpiece, thereby enabling to reduce residual stress at the end edge of the workpiece.

(United States Designation)

In case this international patent application designates the United States, this application claims the benefit of priority based upon Japanese Patent Application No. 2014-75088 filed on Apr. 1, 2014 and Japanese Patent Application No. 2014-264686 filed on Dec. 26, 2014, and the contents of which are incorporated herein by reference.

The invention claimed is:

1. A mold for a press brake, comprising:

an ascending and descending member that is relatively pressed and lowered by an upper table in a press brake, the ascending and descending member provided vertically movably with respect to a mold base mountable on a lower table in the press brake;

a workpiece supporting member provided in the mold base, the workpiece supporting member having an upper surface; and a workpiece pressing member provided in the ascending and descending member, the workpiece pressing member having a lower surface, wherein the upper surface and the lower surface are superposed with each other in a pressing direction so as to define a wedge shaped recess therebetween, and the upper surface of the workpiece supporting member is inclined so that a front side of the upper surface becomes relatively lower than the lower surface of the workpiece pressing member.

2. The mold for a press brake according to claim 1, wherein the mold base includes a workpiece positioning surface that is configured to vertically guide the workpiece pressing member provided in the ascending and descending member, and wherein the workpiece positioning surface is configured to abut on an end edge of a workpiece positioned between the workpiece supporting member and the workpiece pressing member.

3. The mold for a press brake according to claim 2, wherein a striking member protrudable from the workpiece positioning surface in a direction towards the end edge of the workpiece is in the mold base and is configured to be biased toward the end edge of the workpiece.

4. The mold for a press brake according to claim 2, wherein an elastic member configured to abut the end edge of the workpiece is provided in the mold base.

5. The mold for a press brake according to claim 1, wherein the workpiece supporting member is detachable and replaceable with respect to the mold base, and the workpiece pressing member is detachable and replaceable with respect to the ascending and descending member.

6. A hemming method for performing hemming by using the mold for a press brake according to claim 1, wherein when a bent portion of a workpiece bent in a V-shape of an acute angle is positioned between the workpiece pressing member and the workpiece supporting member in the mold for the press brake to perform hemming on the workpiece, a free end side of the workpiece is held in a state of being detached from the lower surface of the workpiece pressing member and the upper surface of the workpiece supporting member, and the bent portion of the workpiece is squashed by the workpiece pressing member and the workpiece supporting member.

* * * * *